US009623654B2

(12) United States Patent
Tamura

(10) Patent No.: US 9,623,654 B2
(45) Date of Patent: Apr. 18, 2017

(54) LIQUID EJECTING CONTROL METHOD AND LIQUID EJECTING APPARATUS

(71) Applicant: CANON KABUSHIKI KAISHA, Tokyo (JP)

(72) Inventor: Yasuyuki Tamura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/149,228

(22) Filed: May 9, 2016

(65) Prior Publication Data

US 2016/0332440 A1 Nov. 17, 2016

(30) Foreign Application Priority Data

May 14, 2015 (JP) ..... 2015-099216

(51) Int. Cl.
*B41J 2/045* (2006.01)

(52) U.S. Cl.
CPC ..... *B41J 2/04551* (2013.01); *B41J 2/0458* (2013.01); *B41J 2/04581* (2013.01); *B41J 2/04588* (2013.01); *B41J 2/04593* (2013.01); *B41J 2/04598* (2013.01)

(58) Field of Classification Search
CPC .. B41J 2/04551; B41J 2/0458; B41J 2/04581; B41J 2/04588; B41J 2/04593; B41J 2/04598
See application file for complete search history.

(56) References Cited

U.S. PATENT DOCUMENTS

| | | | |
|---|---|---|---|
| 5,477,243 | A | 12/1995 | Tamura |
| 5,914,736 | A | 6/1999 | Tamura |
| 6,439,712 | B1 | 8/2002 | Mizutani et al. |
| 6,447,085 | B1 | 9/2002 | Yagi et al. |
| 6,520,613 | B1 | 2/2003 | Tamura |
| 6,601,940 | B2 | 8/2003 | Akama et al. |
| 6,802,583 | B2 | 10/2004 | Tamura |
| 6,969,135 | B2 | 11/2005 | Tamura |
| 7,374,265 | B2 | 5/2008 | Yamane et al. |
| 7,695,090 | B2 | 4/2010 | Kawamura et al. |
| 9,126,402 | B2 | 9/2015 | Tamura |

(Continued)

FOREIGN PATENT DOCUMENTS

| | | |
|---|---|---|
| JP | 2004-230672 | 8/2004 |
| JP | 2010-274177 | 12/2010 |

*Primary Examiner* — Jason Uhlenhake
(74) *Attorney, Agent, or Firm* — Fitzpatrick, Cella, Harper & Scinto

(57) ABSTRACT

There is provided a liquid ejecting control method for outputting an image without an influence of ejection amount variations. Therefore among a plurality of drive modes in which an amount of liquids ejected from one nozzle is different from each other, control information indicating a drive mode to be associated is obtained, and a drive signal to an individual pixel is generated according to the control information and image data that is input for each pixel. The control information sets a drive mode in which an ejection amount closer to a target ejection amount is obtained, among the plurality of drive modes. In addition, a difference between the target ejection amount and the ejection amount to be realized in the set drive mode is found, and this difference is used to correct a target ejection amount of the other pixel in which the drive mode is not set yet.

16 Claims, 10 Drawing Sheets

(56) References Cited

U.S. PATENT DOCUMENTS

| | | | | |
|---|---|---|---|---|
| 9,340,032 | B2 | 5/2016 | Araki et al. | |
| 2014/0002521 | A1* | 1/2014 | Kim | B41J 2/04561 347/10 |
| 2014/0184683 | A1* | 7/2014 | Harjee | H01L 51/0005 347/14 |

* cited by examiner

| NOZZLE No. | 1 | 2 | 3 | 4 | 5 | 6 | 7 | 8 | ··· |
|---|---|---|---|---|---|---|---|---|---|
| | 1 | 5 | 9 | 13 | 17 | 21 | 25 | 29 | ··· |
| | 2 | 6 | 10 | 14 | 18 | 22 | 26 | 30 | ··· |
| | 3 | 7 | 11 | 15 | 19 | 23 | 27 | 31 | ··· |
| | 4 | 8 | 12 | 16 | 20 | 24 | 28 | 32 | ··· |

FIG.5

LIQUID EJECTING CONTROL METHOD AND LIQUID EJECTING APPARATUS

BACKGROUND OF THE INVENTION

Field of the Invention

The present invention relates to a control method for making variations in an ejection amount of individual nozzles unnoticeable in a liquid ejecting apparatus that ejects liquids from a plurality of nozzles respectively.

Description of the Related Art

As inkjet printing apparatuses, in an apparatus that ejects liquids respectively from a plurality of nozzles arranged in a liquid ejection head, there are some cases where variations occur in the amount of liquids ejected from the individual nozzles. In such a case, for example, there occurs a possibility that density unevenness due to the variation in the ejection amount is noticed on a printed image in the inkjet printing apparatus. Therefore, there are conceived various methods for making such a variation in the ejection amount unnoticeable on the image.

For example, Japanese Patent Laid-Open No. 2010-274177 discloses a method in which in a case of manufacturing a color filter using an inkjet technique, one pixel is formed by a predetermined number of nozzles and an average value of the ejection amounts by the predetermined number of the nozzles is uniformed per pixel. According to this configuration, even when there occurs the variation in the ejection amount between the individual nozzles, provided that the ejection amount is adjusted for each group formed of the predetermined number of the nozzles, it is possible to appropriately reduce the density unevenness between the pixels.

In addition, Japanese Patent Laid-Open No. 2004-230672 disclose a method in which, for quantizing multi-valued image data using an error diffusion method, an error generated in the quantization process is corrected according to ejection characteristics of a nozzle corresponding to an individual pixel. When the method disclosed in Japanese Patent Laid-Open No. 2004-230672 is adopted, even if the ejection amount variation of the individual nozzle is not improved, the density is uniformed in some extent of a region on the sheet and the density unevenness can be made difficult to be perceived in visual observation.

However, the method disclosed in Japanese Patent Laid-Open No. 2010-274177 is suitable for the manufacture of the color filter in which the predetermined number of the nozzles can be associated with each of the pixels or the like, and on the other hand, cannot be applied to a case where pixels and dots are associated with each other on a one-to-one basis as in the case of a photo image.

In the method disclosed in Japanese Patent Laid-Open No. 2004-230672, a given density can be obtained in a region having some extent of width, but in a case where an original drawing is not a halftone image like a photo image, but a line drawing configured of fine lines, patterns or the like, the Quantization process is regularly not executed. Therefore there are some cases where the variation in the ejection amount is not corrected and the density unevenness is noticeable. In daring to execute the quantization process as similar to the halftone image, there are some cases where a defect of a dot in the line drawing occurs. In addition, since the density correction is made in the image processing prior to a print operation, it is impossible to preliminarily complete the image processing in a state where a printing apparatus is not associated. As a result, in a case of printing the same image by a plurality of printing apparatuses, the process differs in each of the apparatuses, leading to degradation in working efficiency. Further, in a case of printing by a plurality of printing apparatuses, the density unevenness is improved in the individual image, but the output result possibly differs between the images that are output from the plurality of printing apparatuses. Particularly in a secondary color expressed by a plurality of ink colors in an overlapping manner, the hue possibly differs in each printing apparatus.

SUMMARY OF THE INVENTION

The present invention is made in view of the aforementioned problems, and an object of the present invention is to provide a liquid ejecting control method for realizing liquid adopting without an influence of ejection amount variations regardless of the kind of an original image, not relying on image processing.

According to a first aspect of the present invention, there is provided a liquid ejecting control method for ejecting liquids from a plurality of nozzles comprising: a step for obtaining control information indicating one drive mode to be associated among a plurality of drive modes in which an amount of liquids elected from one nozzle is different from each other; and a drive signal generating step for generating a drive signal to an individual pixel according to the control information and image data that is input for each pixel, wherein the control information is preliminarily set according to a control information setting method including: a step for obtaining a plurality of ejection amounts corresponding to the plurality of drive modes in regard to each of the plurality of nozzles; a setting step for, in regard to one pixel, setting one drive mode out of the plurality of drive modes by comparing the plurality of ejection amounts of the nozzle corresponding to the pixel with a target ejection amount set to the pixel; a difference obtaining step for finding a difference between an ejection amount corresponding to the drive mode set by the setting step and the target ejection amount; and an adjusting step for adjusting a target ejection amount to the other pixel to which the drive mode is not set, based upon the difference.

According to a second aspect of the present invention, there is provided A liquid ejecting apparatus for ejecting liquids from a plurality of nozzles comprising: a unit configured to obtain control information indicating one drive mode to be associated among a plurality of drive modes in which an amount of liquids ejected from one nozzle is different from each other; and a drive signal generating unit configured to generate a drive signal to an individual pixel according to the control information and image data that is input for each pixel, wherein the control information is preliminarily set according to a control information setting method including: a step for obtaining a plurality of ejection amounts corresponding to the plurality of drive modes in regard to each of the plurality of nozzles; a setting step for, in regard to one pixel, setting one drive mode out of the plurality of drive modes by comparing the plurality of ejection amounts of the nozzle corresponding to the pixel and a target ejection amount set to the pixel; a difference obtaining step for finding a difference between an ejection amount corresponding to the drive mode set by the setting step and the target ejection amount; and an adjusting step for adjusting a target ejection amount to the other pixel to which the drive mode is not set, based upon the difference.

Further features of the present invention will become apparent from the following description of exemplary embodiments (with reference to the attached drawings).

BRIEF DESCRIPTION OF THE DRAWINGS

FIG. 5 is a diagram indicating a relation between a nozzle and an ejection element in Embodiment 2;

DESCRIPTION OF THE EMBODIMENTS

Hereinafter, an explanation will be made of modes for carrying out the present invention according to embodiments thereof with reference to the accompanying drawings.

Embodiment 1

Figure 1:
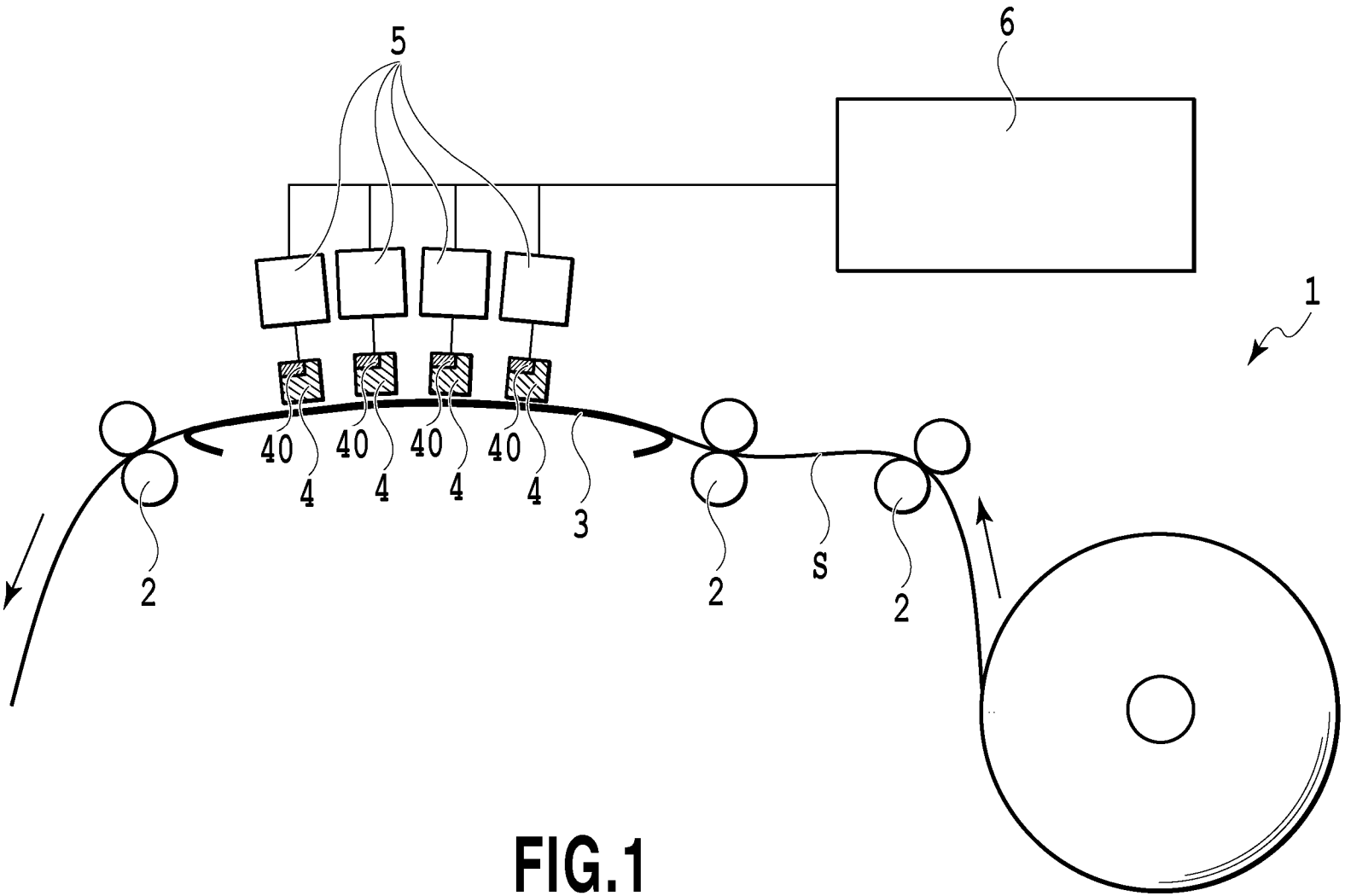
FIG. 1 is a schematic configuration diagram illustrating an inkjet printing apparatus usable as a liquid ejecting apparatus.

FIG. 1 is a schematic configuration diagram illustrating an inkjet printing apparatus 1 usable as a liquid electing control apparatus of the present invention. A continuous sheet S retained in a roll shape is separated in order from the outer circumference with rotation of a roll sheet, and is conveyed in a predetermined speed while being retained between a plurality of sheet conveying rollers 2. Inkjet type liquid ejecting heads 4 (hereinafter, called "IJ head") are disposed along the path of the conveyance route, and eject inks toward the sheet S during the conveyance. In the present embodiment, four IJ heads 4 that eject the inks of cyan, magenta, yellow and black respectively are arranged in order in the conveyance direction, and the backside of the sheet S in the middle of printing is flatly supported by a platen 3.

Each of the IJ heads 4 is controlled in driving by a head control unit 5, and data for ejection thereto is supplied from a drawing control unit 6.

Figure 2:
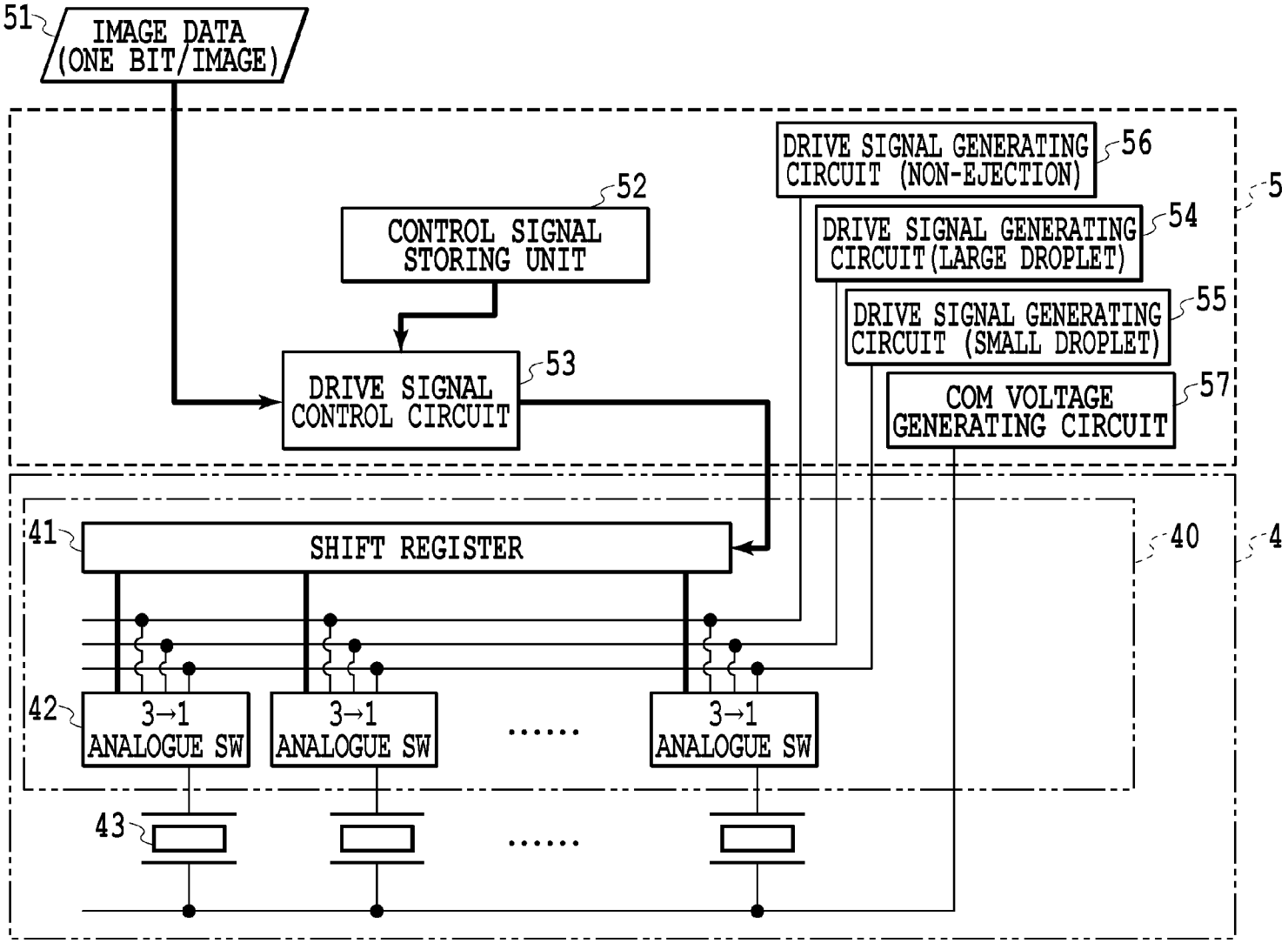
FIG. 2 is a block diagram explaining the configuration of control to an inkjet type liquid ejecting head.

FIG. 2 is a block diagram explaining the configuration of control to the IJ head 4. Here, one set of the IJ head 4 and the head control unit 5 for driving the IJ head 4 is illustrated. In the head control unit 5, image data 51 generated in the drawing control unit 6 is input to a drive signal control circuit 53. The image data 51 is the quantized data as a result of binarization by error diffusion processing or dither processing, and is input corresponding to each pixel as one-bit data indicating ejection (1) or non-ejection (0) in the present embodiment.

A control signal storing unit 52 stores a control signal of one bit associated with each of nozzles arranged in the IJ head 4. The control signal is control information set based upon an ejection state of an individual nozzle, and the setting method will be in detail explained later. The drive signal control circuit 53 combines the image data 51 of one bit received from the drawing control unit 6 with the control signal of the nozzle corresponding to the image data for synthesis, which is transmitted as a two-bit signal per one pixel to a shift register 41 of a driver IC 40.

In addition, the head control unit 5 includes three drive signal generating circuits 54, 55, 56 that generate drive signals for ejecting ink. The drive signal generating circuit 54 generates a drive waveform (hereinafter, referred to as a large droplet waveform) for ejecting a little more ink droplets than a normal amount thereof. The drive signal generating circuit 55 generates a drive waveform (hereinafter, referred to as a small droplet waveform) for ejecting a little less ink droplets than the normal amount. The drive signal generating circuit 56 does not eject ink droplets, but generates a meniscus vibration waveform for vibrating an ink meniscus in the nozzle. Even to the nozzle that does not eject actually ink droplets, the drive signal generating circuit 56 is used to appropriately vibrate the ink meniscus therein, thereby making it possible to prevent an ink clogging in the nozzle or an ejection failure thereof. Further, the head control unit 5 includes a CON voltage generating circuit 57 that generates a bias voltage for application to a common electrode of a piezo element 43 disposed in each nozzle.

Figure 3A:
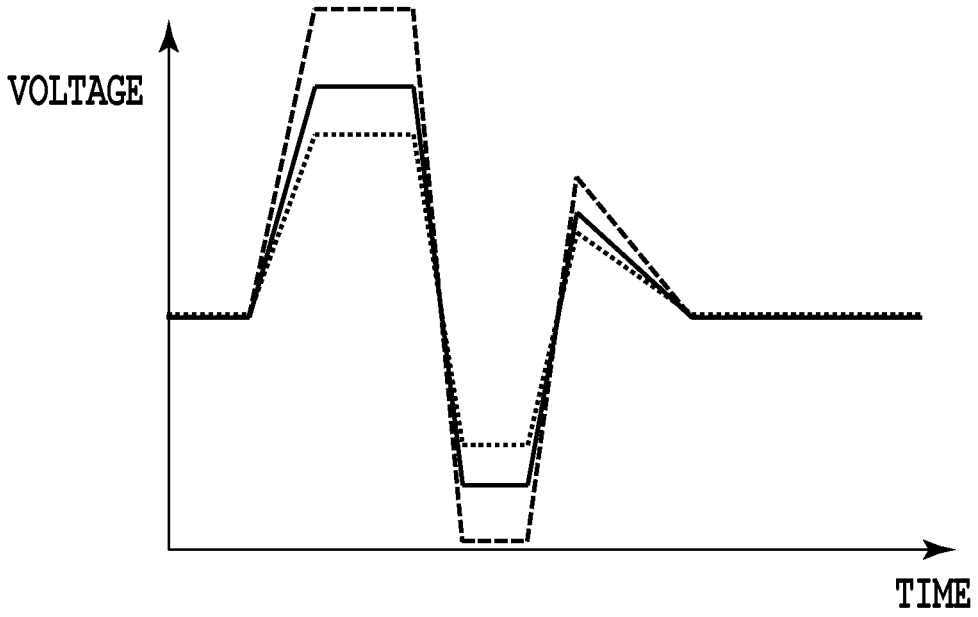
FIG. 3A and FIG. 3B are diagrams each illustrating an example of drive waveforms generated by a drive signal generating circuit.
Figure 3B:
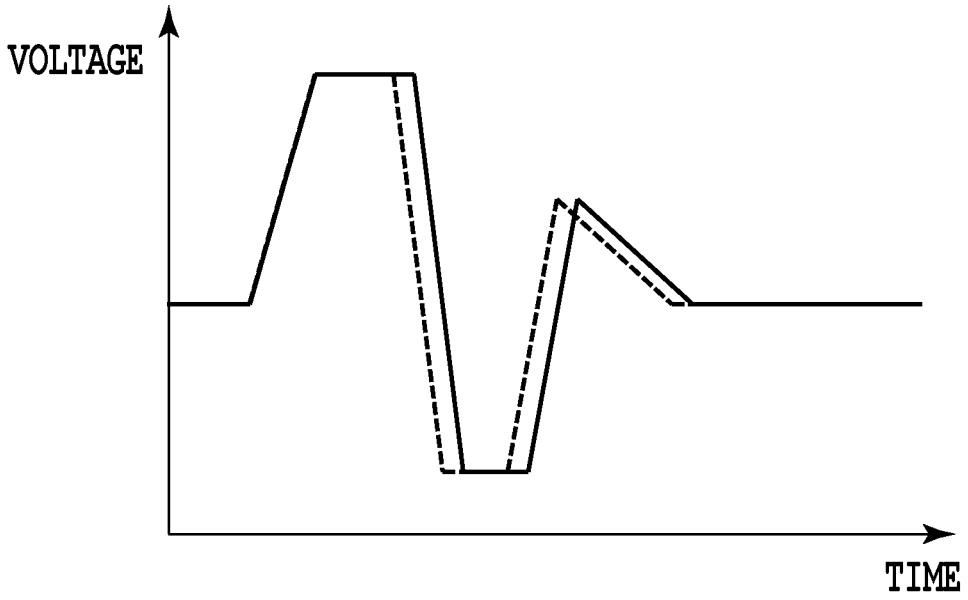

FIGS. 3A and 3B are diagrams illustrating examples of drive waveforms generated by the drive signal generating circuits 54, 55, 56. In the figures, a vertical axis indicates a voltage and a horizontal axis indicates a time. When a voltage to be applied to the piezo element 43 is made high, a pressure chamber of the nozzle inflates, and thereafter, when the voltage is rapidly made small, the pressure chamber deflates to eject the ink as droplets. FIG. 3A indicates a case where an amplitude of a drive voltage is made different to adjust the ejection amount. When the amplitude is made larger than a normal amplitude of the drive voltage shown in a solid line, the ejection amount is made large, and when the amplitude is made smaller than the normal amplitude, the ejection amount is made small. In addition, FIG. 3B indicates a case where an application time of the drive voltage is made different to adjust the ejection amount. The ejection amount can be adjusted by adjusting a cycle of each process of the drive waveform to a cycle of a natural vibration of each of the nozzles.

It should be noted that in the present embodiment, the ejection amount realized by a large droplet waveform and the ejection amount realized by a small droplet waveform do not express a two-step tone, but supplement the variation in the ejection amount on a basis of a normal ejection amount. Therefore it is desirable that a difference in the two-step ejection amount is not so large. In general, a pulse waveform in which a nozzle having the smallest ejection amount among N pieces of nozzles ejects ink droplets in a normal ejection amount is set as the large droplet waveform to be generated by the drive signal generating circuit 54. In addition, a pulse waveform in which a nozzle having the largest ejection amount among N pieces of nozzles ejects ink droplets in the normal ejection amount is set as the small droplet waveform to be generated by the drive signal generating circuit 55.

However, in a case where a nozzle in the ejection amount that has deviated remarkably from the normal ejection amount exists, there occurs a possibility that an average ejection amount of the entire IJ head deviates largely from the normal ejection amount because of this nozzle. In this case, it is preferable to set the large droplet waveform and the small droplet waveform excluding the nozzle having a remarkably small ejection amount and the nozzle having a remarkably large ejection amount. According to the studies of the present inventors, when the election amount upon applying a voltage pulse of the large droplet waveform is the normal ejection amount or more in 80% or more of the nozzles and when the ejection amount upon applying a voltage pulse of the small droplet waveform is the normal ejection amount or less in 80% or more of the nozzles, the appropriate result has been obtained. Accordingly among the all the nozzles, 20% or less of the nozzles in the order of the nozzles having the smaller ejection amount upon determining the large droplet waveform are excluded and 20% or less of the nozzles in the order of the nozzles having the larger ejection amount upon determining the small droplet waveform are excluded.

Back to FIG. 2, the driver IC 40 is provided therein with a shift register 41 that stores the two-bit data to be associated with each of the nozzles, and analogue switches 42 of 3 to 1 for selecting one out of the aforementioned three drive waveforms to each of the piezo elements 43. The analogue switch selects one of the drive waveforms according to the information indicated by the two-bit signal transmitted to the shift register 41 to drive the corresponding piezo element 43. That is, in a case where the two-bit data stored in the shift register 41 indicates the ejection of large droplets, the analogue switch 42 applies the large droplet waveform supplied from the drive signal generating circuit 54 to the piezo element 43. In a case where the two-bit data stored in the shift register 41 indicates the ejection of small droplets, the analogue switch 42 applies the small droplet waveform supplied from the drive signal generating circuit 55 to the piezo element 43. In a case where the two-bit data stored in the shift register 41 indicates the non-ejection, the analogue switch 42 applies the meniscus vibration waveform supplied from the drive signal generating circuit 56 to the piezo element 43.

Figure 4:
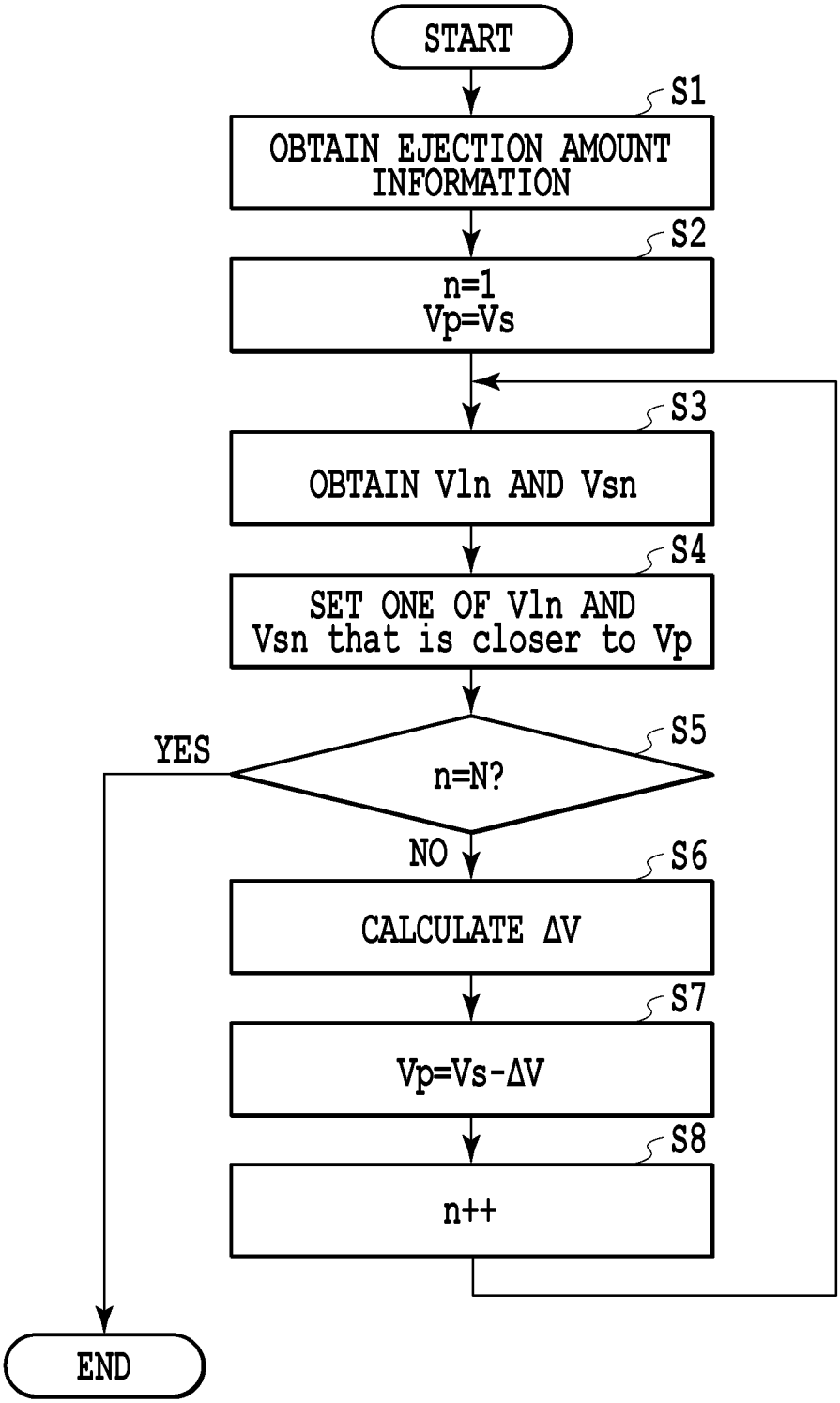
FIG. 4 is a flow chart explaining a setting method of control signals.

FIG. 4 is a flow chart illustrating the method for setting the control information to be stored in the control signal storing unit 52. Here, a control signal is set to each of N pieces of the nozzles arranged in the one IJ head in the order in the arrangement direction one by one. When the present process starts, first in step S1 the ejection amount information in advance measured in regard to all the N pieces of the nozzles is obtained. Specifically the ejection amount in a case of applying a voltage pulse of the large droplet waveform and the ejection amount in a case of applying a voltage pulse of the small droplet waveform are measured, and the two pieces of the ejection amount information are associated with the nozzles to be stored.

On this occasion, in a case where it is difficult to actually measure two-step ejection amounts for each nozzle, the ejection amount of an individual nozzle is measured by a normal drive waveform, and, based thereupon, the ejection amount in a case of applying the large droplet waveform and the ejection amount in a case of applying the small droplet waveform may be estimated in regard to each of the nozzles. Alternatively, a uniform halftone image is printed, and the density distribution may be measured to estimate the ejection amount corresponding to the individual nozzle. In the present embodiment, the ejection amount is not necessarily a physical amount expressed by a unit system such as weight or volume. As long as a parameter indicating the ejection amount is prepared to be associated with each of the nozzles and is capable of expressing a relative distribution in the ejection amount between the nozzles, any numerical value can be used effectively as the parameter. Further, it is not necessary to obtain the ejection amount information in regard to all the nozzles, but obtaining the information in regard to at least two nozzles is sufficient for the ejection amount information.

In step S2, an initial setting is performed. Specifically a parameter n indicating an object nozzle as a processed object is set to n=1, and a target ejection amount Vp of each of the nozzles is set to a normal ejection amount Vs of the IJ head (Vp=Vs).

In step S3, based upon the ejection amount information of N pieces of the nozzles obtained in step S1, the ejection amount information corresponding to the object nozzle n, that is, the ejection amount Vln in a case where the large droplet waveform is applied and the ejection amount Vsn in a case where the small droplet waveform is applied are obtained.

In step S4, it is determined which one of Vln and Vsn is closer to the target ejection amount Vp. When it is determined that Vln is closer to the target ejection amount Vp, a signal (for example, 0) indicating the large droplet waveform is made to be associated with the nozzle n to be stored in the control signal storing unit 52. When it is determined that Vsn is closer to the target ejection amount Vp, a signal (for example, 1) indicating the small droplet waveform is made to be associated with the nozzle n to be stored in the control signal storing unit 52.

In next step S5, it is determined whether or not n is equal to N. When n is equal to N, it is determined that the settings of the control signals in regard to all the nozzles are completed, and the present process ends. On the other hand, when n<N, since the nozzle to which the setting of the control signal is not performed exists, the process goes to step S6.

In step S6, the target ejection amount Vp is subtracted from the ejection amount (Vln or Vsn) selected in step S4 to calculate an error ΔV therebetween (ΔV=(Vln or Vsn)−Vp).

In addition, in the adjustment process of step S7, a value (Vp=Vs−ΔV) found by subtracting the error ΔV from the normal ejection amount Vs of the IJ head is adjusted and determined as a new target ejection amount Vp. Thereafter, after in step S8 the parameter n is incremented, the process goes back to step S3 for processing the next nozzle. Then, the present process ends.

It should be noted that the setting of the control signal as explained in FIG. 4 can be performed in the stage of manufacturing the IJ head 4 or the printing apparatus. In addition, it can be performed according to programs provided in the printing apparatus as one of the maintenance processes to be executed at the shipment time or after the shipment of the printing apparatus.

As described above, the control signal, that is, the drive waveform in regard to each of the nozzles is set, and thereby the normal ejection amount can be maintained by cooperation of a plurality of the nozzles arranged adjacent to each other, thus realizing the image without the density unevenness. The range of this cooperation is not fixed to the specified group as disclosed in Japanese Patent Laid-Open No. 2010-274177, but the individual nozzle is operable substantially independently. As a result, even when the election data of the individual nozzle forms an independent pixel, it is possible to suppress the density unevenness effectively.

In addition, since the density unevenness correction is not made in the image processing as in the case of Japanese Patent Laid-Open No. 2004-230672, there is no possibility that the working efficiency degrades or the output result differs for each of the printing apparatuses. Further, in the present embodiment, since the density unevenness is adjusted by an increase/decrease of the ejection amount, even in a case of printing a line drawing, there is no possibility that a lack of the dot is invited as in the case of Japanese Patent Laid-Open No. 2004-230672.

Incidentally a nozzle that is defined as the start position of the object nozzles, that is, as n=1, is not necessarily the endmost nozzle of all the nozzles. In a case where dummy nozzles are included in both ends in the arrangement direction and only a part of the continuous nozzles is used to perform an ejection operation, the nozzle in the position excluding at least one of the dummy nozzles may be set to n=1.

In step 6 as a difference obtaining process, not the difference between the target ejection amount Vp and the set ejection amount (Vln or Vsn), but a ratio R therebetween (=Vln or Vsn/Vp) may be calculated for expressing the difference therebetween. In this case, in step S7, a value found by dividing the normal ejection amount Vs by the ratio R obtained in step S6 is set as a new target ejection amount (Vp=Vs/R). In addition, a series of these processes can be executed all together.

Further, in the above description, in step S7 the new target ejection amount Vp is calculated by using the entire amount of the error ΔV found in step S6, but, for example, approximately 0.9 times the error ΔV may be used (Vp=Vs−0.9×ΔV). In doing so, in a case where a nozzle in which the election characteristics are remarkably different, such as a non-ejection nozzle, is included, it is possible to avoid the situation where the density unevenness rather deteriorates due to a strong influence of this nozzle given on the circumference.

Embodiment 2

In Embodiment 1, the configuration where the ejection amount is averaged between the plurality of nozzles, that is, between the pixels lining up in the nozzle arrangement direction (first direction) is explained. On the other hand, in the present embodiment, the ejection amount is averaged including pixels arranged in a second direction crossing the nozzle arrangement direction. That is, a control signal can be set for each ejection operation even to the same nozzle. In the present embodiment, control signals corresponding to four ejection operations can be set per one nozzle, and four elements prepared for associating the control signals with the nozzle are defined as ejection elements (pixels). Four×N pieces of ejection elements are prepared to N pieces of nozzles, and the four ejection elements are repeatedly used in each of the nozzles.

FIG. 5 is a diagram illustrating a relation between nozzles and ejection elements. The ejection elements are associated with the nozzles in the order of the ejection elements of k=1 to 4 to the nozzle of n=1, the ejection elements of k=5 to 8 to the nozzle of n=2, the ejection elements of k=9 to 12 to the nozzle of n=3, and so on. In the present embodiment also, the control configuration illustrated in FIG. 2 can be used. The control signals corresponding to 1 to 4×N pieces of the ejection elements are set in the control signal storing unit 52.

In the present embodiment also, it is possible to perform the setting of the control signal according to the flow chart explained in FIG. 4. However, in Embodiment 1 the control signal is set in the order (n=1 to N) of the nozzles, but in the present embodiment the control signal is set in the order (k=1 to 4×N) of the ejection elements. Therefore in the initial setting in step S2, the parameter k of the ejection element is set to k=1. In addition, in step S3 the ejection amount information of the nozzle corresponding to the ejection element k is obtained according to the association as illustrated in FIG. 5. In step S5 it is determined whether or not k=4×N. Only when k=4×N, the present process ends. Further, in step S8, after the parameter k is incremented, the process goes back to step S3 for the process of the next ejection element.

Incidentally the following two methods will be considered as the method in which the drive signal control circuit 53 in the present embodiment combines the control signal provided by the control signal storing unit 52 with the individual image data 51, which is transmitted to the shift register 41.

The first is the method in which, regardless whether the image data of the individual pixel is the ejection (1) or the non-ejection (0), the control signals set by the four ejection elements are combined in order respectively with the image data of the pixels arranged in the second direction. This method has an advantage of being capable of being realized with a simple circuit, but there are some cases where in an image having a cycle tuning to a cycle of the ejection element in the second direction, variations in the ejection amount cannot be sufficiently suppressed. Specifically, for example, in the image in which a dot is printed for every four pixels in the second direction, even when the four ejection elements are independently set, there occurs the situation where the ink is ejected only by the same signal like the large droplets or small droplets.

The second is the method in which only when the image data of the pixel is the ejection (1), the control signals set by the four ejection elements are combined in order. With adoption of this method, even when the ejection (1 and the ejection (0) are arranged in any manner, the ink is ejected in the order of the control signals set to the ejection elements all the time. However, in a case of the present method, since the control signals are not transmitted sequentially, the structure of the control signal storing unit 52 is more complicated as compared to that of the first method.

According to the present embodiment as explained above, it is possible to average the ejection amount in a two-dimension of the nozzle lining direction (first direction) and the direction (second direction) crossing the nozzle lining direction. In addition, in the same nozzle, after averaging the ejection amounts in the four pixels, the remaining error ΔV is further added to the target ejection amount of the adjacent nozzle. Therefore, the density unevenness between nozzles can be furthermore difficult to be noticeable.

Embodiment 3

In the above embodiment, the error ΔV generated in the process of setting the control signal of each of the nozzles or each of the ejection elements is distributed to one ejection element adjacent thereto or one nozzle adjacent thereto. On the other hand, in the present embodiment, the generated error ΔV is distributed to two ejection elements (pixels) adjacent thereto or two nozzles adjacent thereto.

Figure 6:
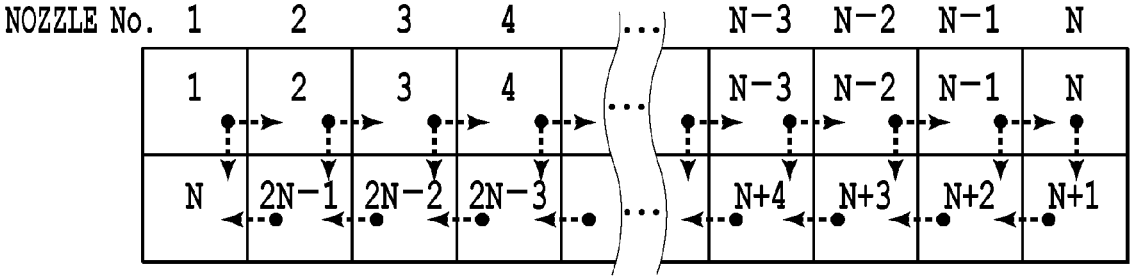
FIG. 6 is a diagram indicating a relation between nozzles and ejection elements and a distribution direction of an error in Embodiment 3.

FIG. 6 is a diagram illustrating a relation between nozzles and ejection elements in the present embodiment and a distribution direction of the error ΔV. In the present embodiment, there are prepared two ejection elements to one nozzle n. However, the two continuous ejection elements k and k+1 are not allotted to the one nozzle as in the case of Embodiment 2. As illustrated in the figure, the ejection elements k=1 to N are allotted to the nozzles n=1 to N of a first ejection element line in this order, and the ejection elements k=N+1 to 2×N are allotted to the nozzles n=N to 1 of a second ejection element line in this order. As similar to Embodiment 1, the control signal is set in the order of 1 to 2×N to the ejection element k.

In the present embodiment also, it is possible to perform the setting of the control signal according to the flow chart explained in FIG. 4. On this occasion, in the initial setting in step S2, the parameter k of the ejection element is set to k=1. In addition, in step S3 the ejection amount information of the nozzle corresponding to the ejection element k is obtained according to the association as illustrated in FIG. 6. In step S5 it is determined whether or not k=2×N. Only when k=2×N, the present process ends.

In step S7 of the present embodiment, the error ΔV generated in step S6 in the ejection element of the processing object is equally distributed to the ejection elements in directions indicated in arrows in FIG. 6 to update the target election amount Vp. In detail, when the election element k is in a range of 1≤k≤N−1, the error ΔV is equally distributed to the ejection elements k+1 and 2×N−k+1 (Vp=Vs−ΔV/2) (Vpn=Vs−ΔV/2, wherein Vpn is a tentative target ejection amount relating to a second ejection element of a $N^{th}$ nozzle). When the ejection element k is in a range of N+1≤k≤2×N, the error ΔV is distributed to the ejection elements k+1 (Vp=Vpn−ΔV). However, in the present embodiment also, it is not necessary to distribute an entire amount of the error ΔV to the surrounding pixels. For example, when the ejection element k is in a range of 1≤k≤N−1, 0.4 times the error ΔV may be distributed to the ejection elements k+1 (Vp=Vs−ΔV×0.4), and 0.3 times the error ΔV may be distributed to the ejection elements 2×N−k+1 (Vpn=Vs−ΔV×0.3).

According to the present embodiment as explained above, as similar to the second embodiment, it is possible to average the ejection amount in a two-dimension of the nozzle lining direction (first direction) and the direction crossing the nozzle lining direction. In addition, the direction of distributing the error ΔV is set to two directions or the direction of distributing the error ΔV is reversed in two ejection element lines. Therefore the density unevenness between nozzles can be equally dispersed, thus making it difficult for the density unevenness to be noticeable. For example, even in a case where there is a nozzle having an extremely small ejection amount or a nozzle of non-ejection, since an influence of the nozzle reaches not in a one-side direction, but equally in a wide range, there is no possibility that the density on one side of this nozzle is locally high, resulting in deteriorating the density unevenness.

Embodiment 4

In the above embodiment, the averaging of the ejection amount is performed in the two steps of the large droplet and the small droplet, but in the present embodiment, an explanation will be made of a case where the averaging of the ejection amount is performed in three steps of a large droplet, an intermediate droplet and a small droplet. One ejection element (pixel) per one nozzle will be prepared as similar to Embodiment 1.

Figure 7:
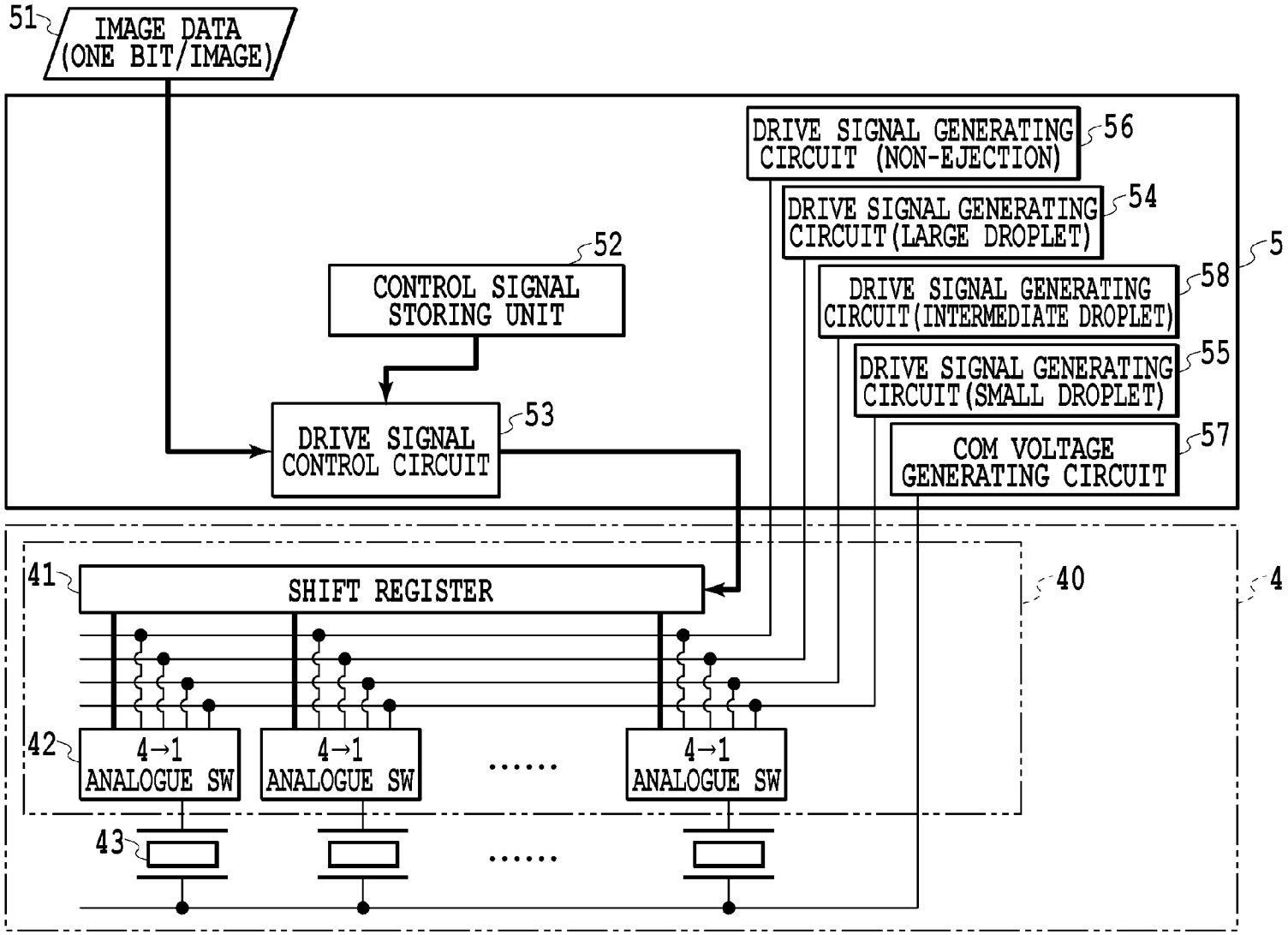
FIG. 7 is a block diagram explaining the configuration of control to an inkjet type liquid ejecting head in Embodiment 4.

FIG. 7 is a block diagram explaining the configuration of the control to the IJ head 4 in the present embodiment. The head control unit 5 in the present embodiment includes four drive signal generating circuits 54, 55, 56, 58. The drive signal generating circuit 54 generates a drive waveform (hereinafter, referred to as a large droplet waveform) for ejecting a little more ink droplets than a normal amount thereof. The drive signal generating circuit 58 generates a drive waveform (hereinafter, referred to as an intermediate droplet waveform) for ejecting a substantially normal amount of ink droplets. The drive signal generating circuit 55 generates a drive waveform (hereinafter, referred to as a small droplet waveform) for ejecting a little less ink droplets than the normal amount. The drive signal generating circuit 56 does not eject ink droplets, but generates a meniscus vibration waveform for vibrating an ink meniscus in the nozzle.

For sectioning information of the large droplet, the intermediate droplet and the small droplet, the control signal storing unit 52 in the present embodiment stores two-bit and three-value of control signals. The drive signal control circuit 53 combines one bit of image data received from the drawing control unit 6 with two bits of control signals corresponding to the image data to generate two-bit and four-value of signals (ejection of large droplets, ejection of intermediate droplets, ejection of small droplets and non-ejection) per one pixel. In addition, this signal is transmitted to the shift register 41 of the driver IC40.

The analogue switch 42 corresponding to the individual nozzle selects a drive waveform according to the information indicated by the two-bit signal transmitted to the shift register 41 to drive the corresponding piezo element 43. That is, in a case where the two-bit data stored in the shift register 41 indicates large droplets, the analogue switch 42 applies the large droplet waveform supplied from the drive signal generating circuit 54 to the piezo element 43. In a case where the two-bit data stored in the shift register 41 indicates intermediate droplets, the analogue switch 42 applies the intermediate droplet waveform supplied from the drive signal generating circuit 58 to the piezo element 43. In a case where the two-bit data stored in the shift register 41 indicates small droplets, the analogue switch 42 applies the small droplet waveform supplied from the drive signal generating circuit 55 to the piezo element 43. In a case where the two-bit data stored in the shift register 41 indicates the non-ejection, the analogue switch 42 applies the meniscus vibration waveform supplied from the drive signal generating circuit 56 to the piezo element 43.

Figure 8:
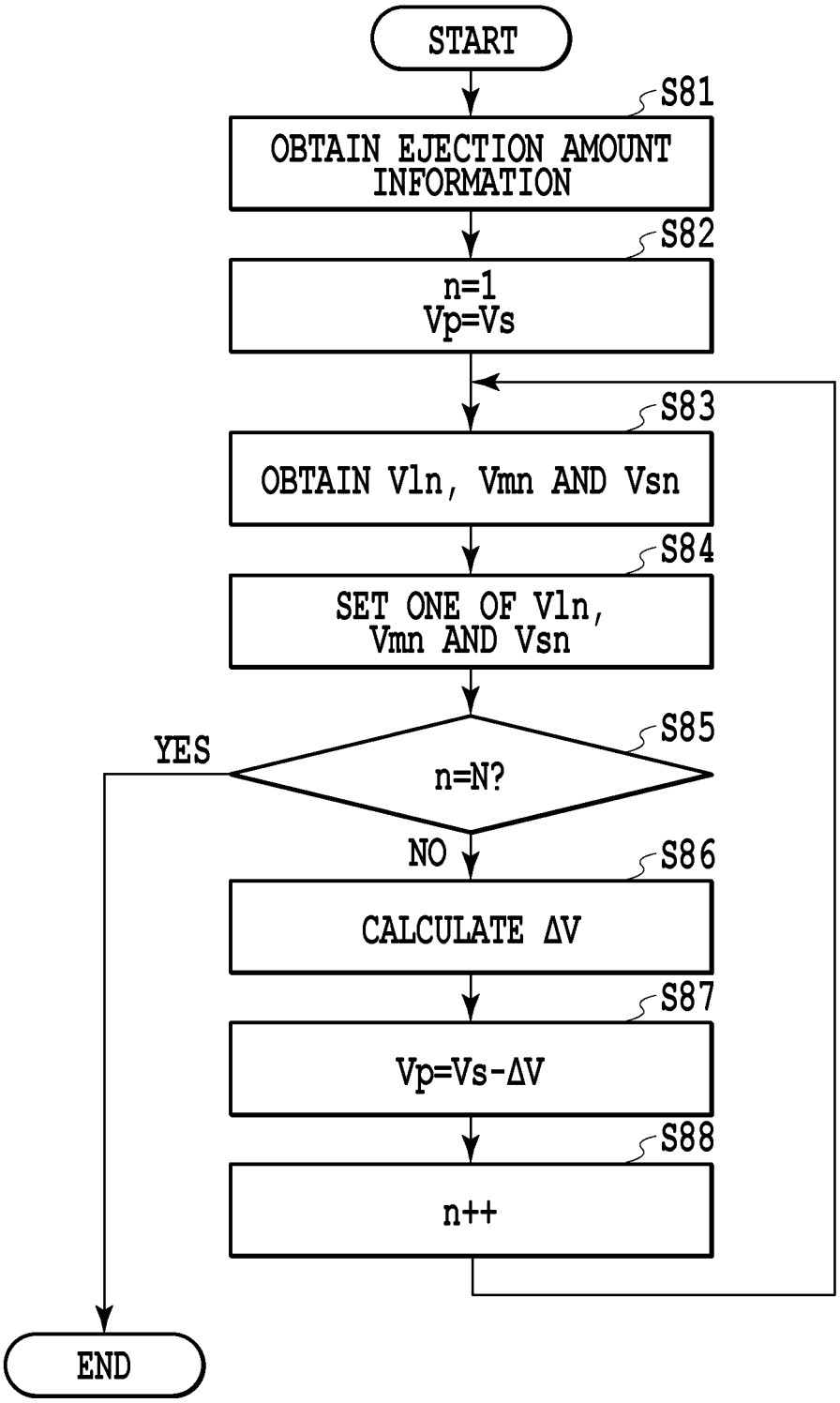
FIG. 8 is a flow chart explaining a setting method of control signals in Embodiment 4.

FIG. 8 is a flow chart explaining the method for setting control signals stored in the control signal storing unit 52. When the present process starts, first in step S81 the ejection amount information in advance measured in regard to all the N pieces of the nozzles is obtained. The ejection amount information obtained in step S81 includes an election amount in a case of applying a voltage pulse of the large droplet waveform, an ejection amount in a case of applying a voltage pulse of the intermediate droplet waveform, and an ejection amount in a case of applying a voltage pulse of the small droplet waveform.

In step S82, an initial setting is performed. Specifically a parameter n indicating an object nozzle as a processed object is set to n=1, and a target ejection amount Vp is set to a normal ejection amount Vs of the IJ head (Vp=Vs).

In step S83, based upon the ejection amount information of N pieces of the nozzles obtained in step S81, the ejection amount information corresponding to the object nozzle n is obtained. That is, three kinds of an ejection amount Vln in a case where the large droplet waveform is applied to the object nozzle n, an ejection amount Vmn in a case where the intermediate droplet waveform is applied to the object nozzle n, and an ejection amount Vsn in a case where the small droplet waveform is applied to the object nozzle n are obtained.

In addition, in step S84, an appropriate one of Vln, Vmn and Vsm is selected, and a signal value of two-bit and three-value indicating the selected control signal is associated with the nozzle n to be stored in the control signal storing unit 52. On this occasion, one of Vln, Vmn and Vsm that is the closest to the target ejection amount Vp may be selected, but two of Vln, Vmn and Vsm that interpose the normal ejection amount therebetween are first selected, and thereafter, one of the two that is closer to the target ejection amount Vp may be selected.

In the former case, the error from the target ejection amount is certainly suppressed to be small to prioritize for an average ejection amount to be closer to the target ejection amount. On the other hand, in the latter case, since a print is performed by droplets close to the normal ejection amount, that is, dots having a relatively same size, the latter case is effective in a case where the pixel density is low and a difference in size between individual dots is inclined to be noticeable.

In next step S85, it is determined whether or not n is equal to N. When is equal to N, it is determined that the settings of control signals in regard to all the nozzles are completed, and the present process ends. On the other hand, when n<N, since the nozzle for which the setting of the control signal is not performed exists, the process goes to step S86.

In step S86, an error ΔV between the ejection amount (Vln, Vmn or Vsn) selected in step S84 and the target ejection amount Vp is calculated (ΔV=(Vln, Vmn or Vsn)−Vp).

In addition, in step S87, a value (Vp=Vs−ΔV) found by subtracting the error ΔV from the normal ejection amount Vs is updated as a new target ejection amount Vp. Thereafter, after in step S88 the parameter n is incremented, the process goes back to step S83 for processing the next nozzle. Then, the present process ends.

According to the present embodiment as explained above, since it is possible to adjust the variations in the ejection amount of the individual nozzle within the individual pixel with higher accuracy as compared with the embodiments as already explained, the density unevenness between nozzles can be furthermore difficult to be noticeable.

Embodiment 5

In the present embodiment, an explanation will be made of a case where image data has three values. In a case of printing an image of a pseudo halftone in three steps of large dot (2), small dot (1) and non-dot (0), small dots are frequently used primarily in a low density portion, and large dots are frequently used in a high density portion. On this occasion, a difference in the ejection amount, that is, the density unevenness is inclined to be more noticeable in the low density portion in which small dots are primarily printed discretely than in the high density portion in which large dots are printed highly densely. Therefore in the present embodiment, a plurality of drive signal Generating circuits as explained in the above embodiment are prepared for the small dots only. It should be noted that in the present embodiment, a normal ejection amount for large dots is set to 5 pl and a normal ejection amount for small dots is set to 2 pl as an example.

In the present embodiment also, the configuration of the control illustrated in FIG. 7 can be adopted. However, the image data 51 is input to correspond to an individual pixel as two-bit and three-value of data indicating printing of large dots (2), printing of small dots (1) or non-printing (0).

On the other hand, the ejection amount to be realized by each of the four drive signal Generating circuits 54, 55, 56, 58 is set as follows. The drive signal generating circuit 54 generates a drive waveform (hereinafter, referred to as a large dot waveform) for ejecting ink droplets of approximately 5 pl. The drive signal generating circuit 55 generates a drive waveform (hereinafter, referred to as a small dot/small droplet waveform) for ejecting a little less small ink droplets than the normal amount. The drive signal generating circuit 58 generates a drive waveform (hereinafter, referred to as a small dot/large droplet waveform) for ejecting a little more small ink droplets than the normal amount. The drive signal generating circuit 56 does not eject ink droplets, but generates a meniscus vibration waveform for vibrating an ink meniscus in the nozzle.

For sectioning two-step information of small droplets, the control signal storing unit 52 in the present embodiment stores one bit of control signals. The drive signal control circuit 53 combines two bits of image data received from the drawing control unit 6 with one bit of control signals corresponding to the image data to generate two-bit and four-value of signals (ejection of large dots, ejection of small dots/large droplets, ejection of small dots/small droplets, and non-election) per one pixel. In addition, these signals are transmitted to the shift register 41 of the driver IC40.

The analogue switch 42 corresponding to the individual nozzle selects a drive waveform according to the information indicated by the two-bit signal transmitted to the shift register 41 to drive the corresponding piezo element 43. That is, in a case where the two-bit data stored in the shift register 41 indicates large dots, the analogue switch 42 applies the large dot waveform supplied from the drive signal generating circuit 54 to the piezo element 43. In a case where the two-bit data stored in the shift register 41 indicates small dots/large droplets, the analogue switch 42 applies the small-dot/large-droplet waveform supplied from the drive signal generating circuit 58 to the piezo element 43. In a case where the two-bit data stored in the shift register 41 indicates small dots/small droplets, the analogue switch 42 applies the small-dot/small-droplet waveform supplied from the drive signal generating circuit 55 to the piezo element 43. In a case where the two-bit data stored in the shift register 41 indicates the non-ejection, the analogue switch 42 applies the meniscus vibration waveform supplied from the drive signal generating circuit 56 to the piezo element 43.

In the present embodiment also, it is preferable to set the large droplet waveform and the small droplet waveform excluding nozzles having a remarkably small ejection amount and nozzles having a remarkably large ejection amount. That is, among all the nozzles, 20% or less of the nozzles in the order from the nozzle having the smaller ejection amount are excluded, and a pulse waveform in which the nozzle of the smallest ejection amount in the remaining nozzles ejects 2 pl of ink droplets is defined as the small-dot/large-droplet waveform to be generated in the drive signal generating circuit 58. In addition, among the all the nozzles, 20% or less of the nozzles in the order from the nozzle having the larger ejection amount are excluded, and a pulse waveform in which the nozzle of the largest ejection amount in the remaining nozzles ejects 2 pl of ink droplets is defined as the small-dot/small-droplet waveform to be generated in the drive signal generating circuit 55. According to the studies by the present inventors, it has been confirmed that a desirable image is obtained when an average ejection amount upon uniformly applying the small-dot/large-droplet waveform to all the nozzles is approximately 2.1 pl and when an average ejection amount upon uniformly applying the small-dot/small-droplet waveform to all the nozzles is approximately 1.9 pl.

In the present embodiment also, the setting of control signals can be performed according to the flow chart explained in FIG. 4. However, since this setting aims at small dots only, only the ejection amount in regard to the small dot is used. Specifically, for example, the ejection amount information obtained in step S1 is information on the ejection amount in a case of application of a voltage pulse of the small-dot/large-droplet waveform and the ejection amount in a case of application of a voltage pulse of small-dot/small-droplet waveform. The normal ejection amount Vs set to the target ejection amount Vp at the initial setting in step S2 is a normal ejection amount (2 pl) for small dots. In step S4 one of the ejection amount Vns of small-dot/small-droplet and the ejection amount Vnl of small-dot/large-droplet, which is closer to the target ejection amount Vp of small dots, of the corresponding nozzle is determined. In step S6 the error ΔV between the ejection amount (Vln or Vsn) of small dots selected in step S4 and the target ejection amount Vp of small dots is calculated (ΔV=(Vln or Vsn)−Vp), and in step S7 the target ejection amount for small dots is updated (Vp=Vs−ΔV).

According to the present embodiment as explained above, in the mode of expressing a multi-tone using different dot sizes, it is possible to adjust the drive waveform to small dots used in a tone region where the density unevenness is inclined to be noticeable. Therefore it is possible to efficiently reduce the density unevenness in the entire tone region.

Embodiment 6

In the embodiments as explained already, each of the nozzles is provided with the piezo element, and the voltage pulse to be applied to the piezo element is adjusted as illustrated in FIGS. 3A and 3B to adjust the ejection amount. On the other hand, in the present embodiment, an explanation will be made of an inkjet printing apparatus in which each of nozzles is provided with an electro-thermal conversion element, wherein a voltage pulse is applied to this element to generate film boring on the surface of the element, and inks are ejected as droplets by development energy of the generated air bubbles.

Figure 9:
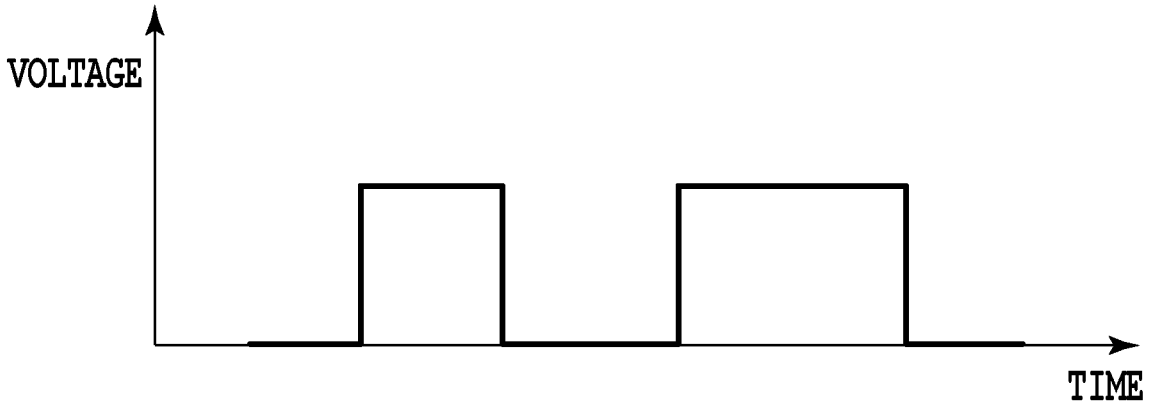
FIG. 9 is a diagram explaining a method for adjusting an ejection amount in a case of using an electro-thermal conversion element.

FIG. 9 is a diagram explaining the method for adjusting the ejection amount in a case of using the electro-thermal conversion element as in the case of the present embodiment. The figure indicates a voltage pulse to be applied to one electro-thermal conversion element (heater) upon performing the ejection of one time. The horizontal axis indicates a time and the vertical axis indicates a voltage.

As seen in the figure, in the present embodiment, for performing an ejection operation of one time, two pulses having different widths are applied. The precedent pulse is a preheat pulse and a pulse for heating the ink in contact with the heater. On the other hand, the subsequent pulse is a main heat pulse, and a pulse for generating the film boiling in the ink heated by the preheat pulse to realize the ejection operation. In a case of the IJ head configured to use the electro-thermal conversion element as a print element, it is known that the ejection amount of ink depends on an ink temperature at the ejection time and the ejection amount is adjustable by changing a pulse length of the preheat pulse. Accordingly in the present embodiment, the pulse length of the preheat pulse is prepared in two steps, and thereby the large droplet waveform and the small droplet waveform are realized.

Figure 10A:
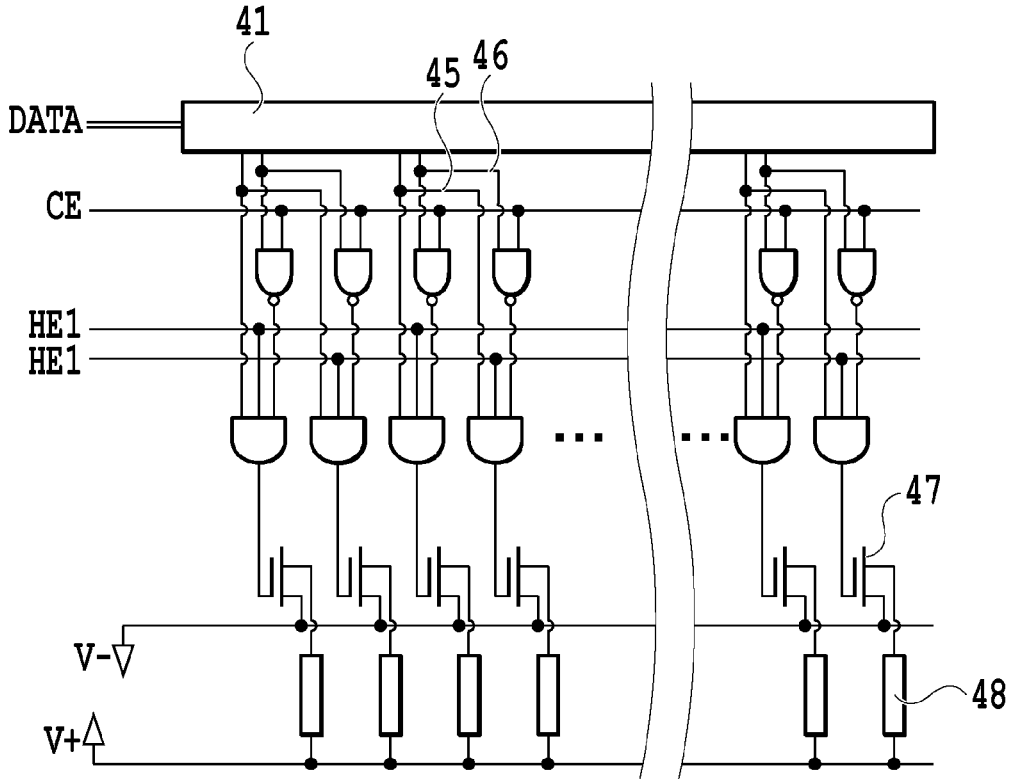
FIGS. 10A and 10B are a drive circuit diagram and a timing chart of an inkjet type liquid ejecting head.
Figure 10B:
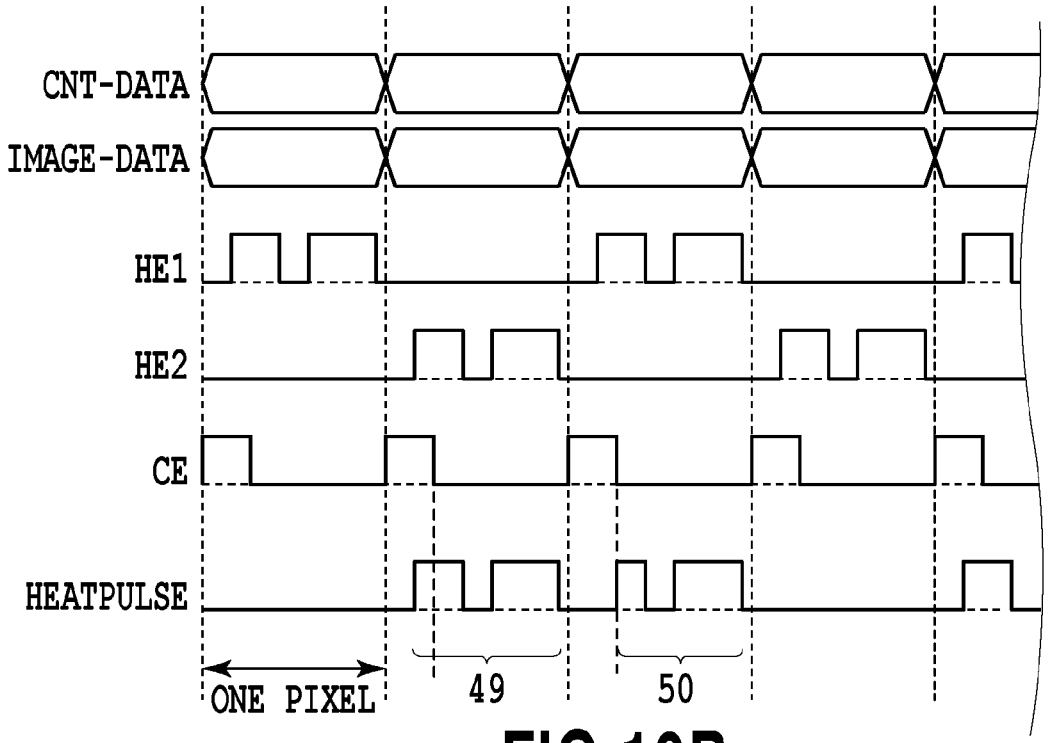

FIGS. 10A and 10B are a drive circuit diagram of the IJ head 4 and a timing chart in the present embodiment. The shift register 41 stores two-bit data per one nozzle (pixel). Among the two-bit data, one bit is image data, and is output through an image data line 45 from the shift register 41. IMAGE-DATA in FIG. 10B corresponds to the image data, a state of High indicates ejection, and a state of Low indicates non-ejection. Among the two-bit data, another one bit is a control signal, and is output through an image data line 46 from the shift register 41. CNT-DATA in FIG. 10B corresponds to the control signal, a state of High indicates small droplets, and a state of Low indicates large droplets.

In the IJ head of performing the ejection operation using the thermal energy as in the case of present embodiment, since the current flowing instantly is large, there are many cases where nozzles are divided into a plurality of blocks to perform time-sharing drive. In the present embodiment also, all the nozzles are divided into a nozzle group (block 1) of nozzles in even numbers and a nozzle group (block 2) of nozzles in odd numbers, each being driven by different timings. In the figure, a drive pulse for block 1 is indicated at HE1, and a drive pulse for block 2 is indicated at HE2. As seen in FIG. 10B, the drive timings deviate from each other such that these pulses do not become High simultaneously.

CE is a signal that defines a size of a preheat pulse of a small droplet, and as illustrated in FIG. 10B, is regularly sent out in synchronization with IMAGE-DATA. When the control signal indicates large droplets, CE is ignored and HEAT PULSE 49 for large droplet in FIG. 10B is generated to drive a heater 48. A pulse shape of HEAT PULSE 49 for large droplet is the same as a shape of a heat pulse sent out to HE1 or HE2. When the control signal indicates small droplets, a part of the heat pulses are deleted when CE is High. Thereby the preheat pulse in the heat pulse sent out to HE1 or HE2 is partially deleted to generate HEAT PULSE 50 for small droplet in FIG. 10B and drive the heater 48.

Even in a case of using the IJ head having the configuration explained above, the effect similar to Embodiment 1 can be obtained by switching the large droplet and the small droplet with the method explained in the above embodiment.

Other Embodiments

As described above, the explanation is made of the mode in which, for reducing the loads for the processing, one control signal is associated with one nozzle or a predetermined plurality of control signals are associated with one nozzle. However, the present invention may set control signals independently to all the pixels in an image in an estimated size, for example. On this occasion, an error ΔV generated in an individual pixel can be distributed not only to the two pixels illustrated in FIG. 6 but also to furthermore pixels positioned in the vicinity thereof according to a predetermined diffusion coefficient.

In addition, in the embodiments explained above, the voltage pulse for applying to the individual nozzle is changed as explained in FIG. 3A, FIG. 3B, or FIG. 9 to adjust the ejection amount. However, the ejection amount adjusting method is not limited to this mode. For example, in a case of being capable of ejecting inks to the same pixel from a plurality of nozzles, when nozzles for ejecting large droplets and nozzles for ejecting small droplets are separately prepared, the effect similar to the above embodiment can be obtained. Particularly in a case of the IJ head configured to eject ink using the thermal energy as in the case of Embodiment 6, it is relatively easy and effective to adopt this configuration. In addition, in this case, even when a nozzle of non-ejection occurs, since the ejection operation can be performed with another nozzle without a failure, it is possible to avoid the lack of the dot.

In addition, the explanation is made of the case of the mode of using the piezo element as the print element and the mode of using the electro-thermal conversion element as the print element, but the present invention is not limited these modes. As long as there are prepared a plurality of drive modes capable of realizing a plurality of ejection amounts, the effect similar to the above embodiments can be realized, and the present invention can be accomplished effectively.

In addition, in the above embodiments, the explanation is made of the case of ejecting inks containing color materials to print the image on the sheet as an example. The present invention is not limited to this mode, either. For example, the present invention can be applied to industrial inkjet printing apparatuses such as a manufacturing apparatus of a color filter for crystal display or an apparatus for forming electrical wires using conductive ink. Furthermore, for example, ink may be a transparent liquid, and an object for application of ink is not a sheet but a cubic object.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-099216, filed May 14, 2015, which is hereby incorporated by reference wherein in its entirety.

What is claimed is:

1. A liquid ejecting control method for ejecting liquids from a plurality of nozzles comprising:

a step for obtaining control information indicating one drive mode to be associated among a plurality of drive modes in which an amount of liquids ejected from one nozzle is different from each other; and a drive signal generating step for generating a drive signal to an individual pixel according to the control information and image data that is input for each pixel, wherein the control information is preliminarily set according to a control information setting method including:

a step for obtaining a plurality of ejection amounts corresponding to the plurality of drive modes in regard to each of the plurality of nozzles;

a setting step for, in regard to one pixel, setting one drive mode out of the plurality of drive modes by comparing the plurality of ejection amounts of the nozzle corresponding to the pixel with a target ejection amount set to the pixel;

a difference obtaining step for finding a difference between an ejection amount corresponding to the drive mode set by the setting step and the target ejection amount; and an adjusting step for adjusting a target ejection amount to the other pixel to which the drive mode is not set, based upon the difference.

2. The liquid ejecting control method according to claim 1, wherein the setting step sets a drive mode corresponding to an ejection amount that is the closest to the target ejection amount among the plurality of ejection amounts, the difference obtaining step calculates a difference between the ejection amount corresponding to the drive mode set by the setting step and the target ejection amount as the difference, and the adjusting step corrects the target ejection amount by subtracting the difference from a normal ejection amount set to the other pixel to which the drive mode is not set.

3. The liquid ejecting control method according to claim 1, wherein the control information is set to each of the plurality of nozzles one by one, and the adjusting step corrects the target ejection amount to a nozzle, to which the drive mode is not set, adjacent to the nozzle to which the drive mode is set by the setting step.

4. The liquid ejecting control method according to claim 1, wherein a plurality of pieces of the control information are respectively set to each of the plurality of nozzles, and the adjusting step, in a case where there exists a pixel that corresponds to the same nozzle as the pixel to which the drive mode is set by the setting step and to which the drive mode is not set, corrects the target ejection amount to the pixel, and in a case where there does not exist a pixel that corresponds to the same nozzle as the pixel to which the drive mode is set by the setting step and to which the drive mode is not set, and that is adjacent to the pixel, corrects the target ejection amount to a pixel that corresponds to a nozzle adjacent to the nozzle and to which the drive mode is not set.

5. The liquid ejecting control method according to claim 4, wherein the drive signal generating step, regardless of whether the image data indicates the ejection or the non-ejection, combines the plurality of pieces of the control information set corresponding to the one nozzle with the image data in order, thus generating the drive signal.

6. The liquid ejecting control method according to claim 4, wherein the drive signal generating step, only in a case where the image data indicates the ejection, combines the plurality of pieces of the control information set corresponding to the one nozzle with the image data in order, thus generating the drive signal.

7. The liquid ejecting control method according to claim 1, wherein a plurality of pieces of the control information are respectively set to each of the plurality of nozzles, and the adjusting step corrects the target ejection amount to a plurality of pixels, to which the drive mode is not set, adjacent to the pixel to which the drive mode is set by the setting step.

8. The liquid ejecting control method according to claim 7, wherein the adjusting step adjusts a target ejection amount to the plurality of pixels by associating the difference with the plurality of pixels for division.

9. The liquid ejecting control method according to claim 1, wherein a plurality of pieces of the control information are respectively set to each of the plurality of nozzles, and the adjusting step includes:

a step for correcting the target ejection amount to a pixel, to which the drive mode is not set, adjacent in a predetermined direction where the nozzles are arranged to the pixel to which the drive mode is set by the setting step; and a step for correcting the target ejection amount to a pixel, to which the drive mode is not set, adjacent in a direction in reverse to the predetermined direction to the pixel to which the drive mode is set by the setting step.

10. The liquid ejecting control method according to claim 1, wherein the image data includes information for defining printing or non-printing in regard to a plurality of dot sizes, and the control information indicates a drive mode to be associated among the plurality of drive modes of at least a part of the plurality of dot sizes.

11. The liquid ejecting control method according to claim 1, wherein in one of the plurality of drive modes, in a case of driving the plurality of nozzles by the drive mode, 80% or more of the nozzles out of the plurality of nozzles eject liquids of an amount that is the same as a predetermined normal ejection amount or less, and in a different one of the plurality of drive modes, in a case of driving the plurality of nozzles by the drive mode, 80% or more of the nozzles out of the plurality of nozzles eject liquids of an amount that is the same as the predetermined normal ejection amount or more.

12. The liquid ejecting control method according to claim 1, wherein in one of the plurality of drive modes, in a case of driving the plurality of nozzles by the drive mode, every one of the plurality of nozzles ejects liquids of an amount that is the same as a predetermined normal ejection amount or less, and in a different one of the plurality of drive modes, in a case of driving the plurality of nozzles by the drive mode, every one of the plurality of nozzles ejects liquids of an amount that is the same as the predetermined normal ejection amount or more.

13. The liquid ejecting control method according to claim 1, wherein the plurality of nozzles include a part of continuous nozzles in a plurality of nozzles arranged in a liquid ejecting head.

14. The liquid ejecting control method according to claim 1, wherein in the plurality of drive modes, a waveform of a voltage pulse applied to a piezo element provided in the nozzle differs from each other.

15. The liquid ejecting control method according to claim 1, wherein in the plurality of drive modes, a waveform of a voltage pulse applied to an electro-thermal conversion element provided in the nozzle differs from each other.

16. A liquid ejecting apparatus for ejecting liquids from a plurality of nozzles comprising:

a unit configured to obtain control information indicating one drive mode to be associated among a plurality of drive modes in which an amount of liquids ejected from one nozzle is different from each other; and a drive signal generating unit configured to generate a drive signal to an individual pixel according to the control information and image data that is input for each pixel, wherein the control information is preliminarily set according to a control information setting method including:

a step for obtaining a plurality of ejection amounts corresponding to the plurality of drive modes in regard to each of the plurality of nozzles;

a setting step for, in regard to one pixel, setting one drive mode out of the plurality of drive modes by comparing the plurality of ejection amounts of the nozzle corresponding to the pixel and a target ejection amount set to the pixel;

a difference obtaining step for finding a difference between an ejection amount corresponding to the drive mode set by the setting step and the target ejection amount; and an adjusting step for adjusting a target ejection amount to the other pixel to which the drive mode is not set, based upon the difference.

* * * * *